US011326395B2

(12) United States Patent
Heissenberg

(10) Patent No.: US 11,326,395 B2
(45) Date of Patent: May 10, 2022

(54) RETRACTABLE SCREEN WITH HORIZONTAL TENSIONING TRACK AND VERTICAL BIASING MEMBER

(71) Applicant: Michael Heissenberg, Port St. Lucie, FL (US)

(72) Inventor: Michael Heissenberg, Port St. Lucie, FL (US)

( * ) Notice: Subject to any disclaimer, the term of this patent is extended or adjusted under 35 U.S.C. 154(b) by 239 days.

(21) Appl. No.: 16/838,657

(22) Filed: Apr. 2, 2020

(65) Prior Publication Data

US 2020/0318430 A1 Oct. 8, 2020

Related U.S. Application Data

(60) Provisional application No. 62/828,758, filed on Apr. 3, 2019.

(51) Int. Cl.
*E06B 9/58* (2006.01)
*E06B 9/54* (2006.01)

(52) U.S. Cl.
CPC . *E06B 9/58* (2013.01); *E06B 9/54* (2013.01)

(58) Field of Classification Search
CPC ... E06B 9/58; E06B 9/54; E06B 9/582; E06B 2009/588
See application file for complete search history.

(56) References Cited

U.S. PATENT DOCUMENTS 2,267,869 A * 12/1941 Loehr ..... E06B 9/34 160/89
2,407,784 A * 9/1946 Hoffstad ..... E06B 9/54 160/273.1
2,942,366 A 6/1960 Pfaff, Jr. et al.
3,358,410 A 12/1967 Dawdy et al.
3,516,473 A 6/1970 Rosenquist
3,548,555 A 12/1970 Trostle et al.
3,996,706 A 12/1976 Bomgaars
4,921,031 A 5/1990 Wagner et al.
5,260,853 A 11/1993 Yap et al.
5,320,154 A * 6/1994 Colson ..... E06B 9/171 160/121.1
5,351,742 A 10/1994 Lichy
(Continued)

FOREIGN PATENT DOCUMENTS

ES 2561905 3/2016
KR 101469503 12/2014
WO WO-2017212346 A1 * 12/2017 ..... E06B 9/581

*Primary Examiner* — Johnnie A. Shablack
(74) *Attorney, Agent, or Firm* — McHale & Slavin, P.A.

(57) ABSTRACT

A retractable screen device for a framed opening employing a frame track fastened to each side support of the framed opening; the frame track forming a compartment for receipt of a guide rail with a decompression gasket positioned between the frame track and the guide rail. A screen mounted on a horizontally disposed rotatable shaft secured to a header of the opening has laterally opposed side edges with an elongated flexible protrusion secured along the length of each side edge. The guide rail receives and guides the screen protrusion along a longitudinal direction, and the decompression gasket allows the guide rail to traverse the frame track side walls to permit the screen to flex while maintaining a consistent tension on the screen. Vertical tension adjustment is provided by use of a biasing member coupled to the center axle that activates when the screen is deployed.

9 Claims, 10 Drawing Sheets

(56) References Cited

U.S. PATENT DOCUMENTS 5,479,979 A 1/1996 Hayashiguchi
5,526,865 A 6/1996 Coenraets
6,234,644 B1 5/2001 Kotovsky et al.
6,237,667 B1 * 5/2001 Fraczek ..... E06B 9/46 160/121.1
6,263,949 B1 7/2001 Guthrie, Jr.
6,688,056 B2 2/2004 Von Hoyningen Huene et al.
6,851,464 B2 2/2005 Hudoba et al.
6,971,831 B2 12/2005 Fattori et al.
7,066,526 B2 6/2006 Weddington et al.
7,100,667 B2 * 9/2006 Tomita ..... E06B 9/54 160/23.1
7,114,545 B2 10/2006 Null
7,143,556 B2 12/2006 Hales
7,150,244 B2 12/2006 Dawes
7,360,575 B2 4/2008 Weiss
7,389,807 B2 * 6/2008 Nagare ..... E06B 9/13 160/268.1
7,793,702 B2 9/2010 Biewer et al.
7,797,901 B2 9/2010 Near
7,984,743 B2 7/2011 Rossato
8,037,921 B2 * 10/2011 Dondlinger ..... E06B 9/17 160/268.1
8,225,572 B2 7/2012 Wallace
8,490,331 B2 7/2013 Quesada
8,602,081 B2 * 12/2013 Komatsu ..... E06B 9/581 160/273.1
8,607,841 B2 12/2013 Hayashiguchi
8,662,138 B2 * 3/2014 Komatsu ..... E06B 9/13 160/272
8,857,887 B1 10/2014 Schmeichel
9,347,258 B2 * 5/2016 Dwarka ..... E06B 9/24
9,556,669 B2 * 1/2017 Lombardini ..... E06B 9/38
9,683,407 B2 * 6/2017 Diamond ..... E06B 9/44
9,719,292 B1 8/2017 James et al.
9,982,483 B2 * 5/2018 Nakae ..... E06B 9/582
10,036,198 B2 7/2018 James et al.
10,260,279 B2 * 4/2019 Nakae ..... E06B 9/54
2002/0175321 A1 11/2002 Larsen et al.
2005/0139334 A1 6/2005 Bernardi
2006/0137836 A1 6/2006 Harbison
2009/0173454 A1 7/2009 Cheng
2011/0260027 A1 10/2011 Farnham, Jr.
2015/0041076 A1 2/2015 Andre de la Porte
2018/0313149 A1 11/2018 James et al.

* cited by examiner

RETRACTABLE SCREEN WITH HORIZONTAL TENSIONING TRACK AND VERTICAL BIASING MEMBER

PRIORITY CLAIM

In accordance with 37 C.F.R. § 1.76, a claim of priority is included in an Application Data Sheet filed concurrently herewith. Accordingly, the present application claims the priority date of U.S. Provisional Patent Application No. 62/828,758 filed Apr. 3, 2019 entitled "RETRACTABLE SCREEN WITH TENSIONING TRACK" the contents of which are incorporated herein by reference.

FIELD OF THE INVENTION

The present invention relates to the field of retractable screens and, more particularly, to a retractable screen having decompression gaskets coupling guide rails with frame tracks to maintain the screen in a taunt horizontal direction and a biasing means to allow for uneven floor surfaces to maintain the screen without sagging in a vertical position.

BACKGROUND OF THE INVENTION

Screening is commonly used to allow individuals to enjoy the outdoors by providing some of the benefits of indoor living. Screens may be used to keep bugs out of a living space, provide shading, reduce wind speed, operate as a wall member, and so forth. By way of example, a screen may have sized openings that can prevent flies, mosquitos or Ceratopogonidaes (no-see-ums) from entering an outdoor living space such as a patio or pool area. A screen may also be adapted to provide a bug free garage area, effectively extending the living area of a home when weather permits. Still another example would be the use of a screen to protect a pool area from small children that are attracted to water.

Typically, an outdoor space may consist of a patio that is attached to a home, thereby extending the living space of the home by use of a screened-in area. The screen may not always be needed, and is preferably stored away when conditions are right. For instance, during sunny cool days, a screened in patio has little or no benefit. However, during a warm summer night, the same patio may be unusable without screen protection from the bugs. Screens are especially beneficial during twilight hours when the screened-in space is illuminated, as bugs are naturally attracted to light. Sunlight hours are not without their need of screening; a screen can provide shade protection from the sun, yet allow a flow of air to pass through the space.

With screening providing so many benefits, improvements in screen attachment becomes important. The preferred method of attachment is the use of a retractable screen that rolls from a cylinder positioned along a header placed at the top of an opening to be protected. The edges of the screen are secured to a track that essentially prevents bugs and the like from going around the edges of the screen. The problem with all known retractable screens is that the tracks used to capture the edge of the screens can bind, making the deployment and/or retraction difficult. The tracks can cause binding from any number of conditions. A slight wind can place pressure on the screen, causing a frictional, engagement with the track. Variations in temperature can cause track and screen constrictions. Installation being as little as ⅛ inch from the top of a screen track to the bottom of the screen track can cause binding. Sizing of the screen itself may be off as little as ⅛ inch, causing the same problem as misaligned tracks.

Known improvements of the screen have attempted to resolve this problem by including the placement of a plastic bead or zipper-like attachment to the edge of the screen to reduce friction. Other known improvements are the use of plastic tracks, which are more forgiving than aluminum, to allow the screens to slide more easily. Still other known devices use flexible tracks, compression bulbs to make a track flexible, foam materials which operate essentially the same way as compression bulbs, and stretchable spring clips. However, all known devices fail to address screen alignment issues that may be due to track installation, screen cutting, or age that may cause a conventional screen installation to jam or fail prematurely.

Screen attachment is further complicated by the fact that the consumer does not want a screen that wrinkles or flutters in the wind. If the screen is drawn tight, an impact on the screen near a point of minimal give makes the screen most vulnerable to breaking. For instance, if a broom handle strikes a screen that is taut, the handle will likely breach the screen. If a screen is used to protect a pool, should a small child breach the screen, the results can be life changing. The optimum screen installation is to keep the screen tight, but allow flexibility to handle deployment, retraction, wind gusts, and impact strikes.

U.S. Patent Publication 2006/0137836 discloses a sealing curtain assembly having a pair of tracks attached to opposite sides of an opening. Each track includes a spring system which urges the tracks outwardly to maintain the curtain taut. The spring system employs a connecting member, preferably a bolt, which allows the track edges to separate from a frame member. In one embodiment, a compression spring and washer are located between the head of each connecting member and track. A problem with the use of spring loaded connecting members is that the spacing between each member provides an area for the screen to bind between connecting members.

U.S. Pat. No. 8,607,841 discloses a screen device having inner rails that are embedded inside fixed guide rails which guide protrusions at side edges of a screen which is wound via a take-up shaft. Each inner rail has a guide groove in which the guide protrusion is inserted, and inward flanges are provided at an opening of the guide groove. Rail members have outer side protrusions and inner side protrusions of different heights at both side edges of a rail base plate. The higher outer side protrusions are confronting. A micro gap extends between the lower inner side protrusions into the guide groove such that the micro gap is opposed to a guide gap formed between the opposed inward flanges. The guide protrusion is slid and guided in a come-off preventing state by the inner side protrusion, so that an extremely thin fastener element can be used as the guide protrusion. While spacing of the screen edge allows for movement, the use of an inner guide rail that is spaced apart allows for screen wrinkles.

U.S. Pat. No. 9,719,292 discloses a magnetic track assembly employing magnets. A first magnet is disposed within an aluminum channel, and a screen receiver is disposed within the compartment including a second magnet arranged facing the first magnet. In the magnetic track assembly, the first and second magnets are of opposite polarity and the screen receiver is loosely disposed within the compartment such that a magnetic bond is intact between the first and second magnets when the first and second magnets are close together and the magnetic bond is broken when the first and second magnets are pulled apart. A problem with the use of magnetics is that spacing between magnets allows for binding of the screen since there is no graduated loading provided by the magnets. The magnets have a strong attachment which can lead to screen binding and, since the magnets and aluminum compartment are constructed of dissimilar materials, the components will lead to corrosion, especially when used near salt water.

What is needed in the art is a screen track capable of providing a continuous resistance along each edge of a screen to facilitate opening/closing, eliminating wrinkles, and accommodate uneven floor surfaces.

SUMMARY OF THE INVENTION

A retractable screen device for a framed opening employing a frame track fastened to each side support of the framed opening forming a compartment having a front receptacle, opposing side walls having a depth, and a front wall having a centrally disposed access channel extending the longitudinal length of the frame track is disclosed. A guide rail is positioned within each compartment of each frame track extending the longitudinal length of each frame track. The guide rail has a front chamber axially aligned with the centrally disposed channel and a rear receptacle extending the longitudinal length of the guide rail with opposing side walls having a depth. A decompression gasket is positioned between the frame track and the guide rail.

A screen having a length configured to be wound onto and deployed from a horizontal disposed rotatable shaft secured to a header of the opening has laterally opposed side edges with an elongated flexible protrusion secured along the length of each side edge. Each guide rail is constructed and arranged to receive and guide the screen protrusion along a longitudinal direction, and the decompression gasket allows the guide rail to traverse the frame track side walls to permit the screen to flex while maintaining a consistent tension on the screen.

A biasing means is attached to the axle used to roll up the screen. The biasing means, preferably a flexible piece of rubber, allows the bottom of the screen to accommodate uneven surfaces by placing tension on the screen in a vertical format.

It is an objective of the invention to provide a retractable screen device that allows for ease of deployment and retraction by providing a mechanism that allows screen flexible.

Still another objective of the invention is to provide a device that accommodates uneven horizontal screen positions and uneven vertical screen surfaces.

Still another objective of the invention is to eliminate the "smile" screen which is an industry reference to an ill adjusted screen that sags causing a smile like appearance.

It is another objective of the instant invention to provide a retractable screen that addresses screen wrinkles due to improper installation alignment, improper screen sizing, or screen shrinkage/expansion due to extremes in cold or hot environments.

Still another objective of the invention is to extend the life of a screen by providing a mechanism that reduces the strain on screens, thereby extending the life of the screens as they become brittle due to age.

Another objective of the invention is to teach the use of a variable tensioning device in the form of a decompression gasket to inhibit jamming of a screen during deployment or retraction if the screen is not pulled evenly.

Still another objective of the invention is to teach the use of a rubber decompression gasket to provide a consistent tension along the side edges of a retractable screen, assimilating the flexibility of a trampoline.

Yet still another objective of the invention is to teach the use of a biasing member to allow a screen to accommodate uneven floor surfaces and allowing the screen to remain wrinkle free.

Still another objective of the invention is to provide a biasing means to allow a rolling screen to automatically adjust when it meets with the floor, wherein the floor can be sloped right to left, left to right, crowned in the center or dipped in the center.

Yet another objective of the invention is the use of compatible materials to eliminate corrosion due to dissimilar metals.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Figure 1:
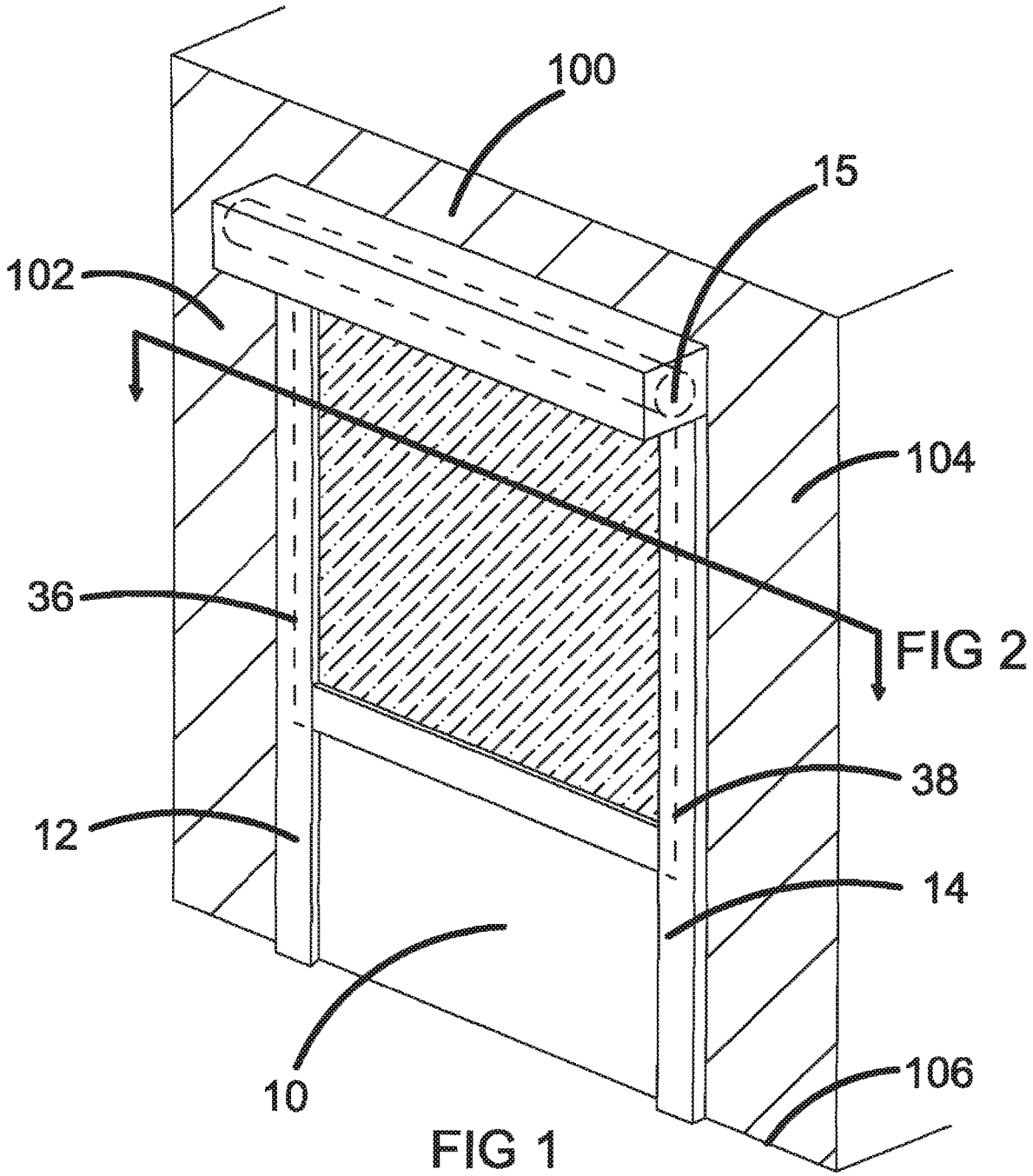
FIG. 1 is a perspective view of the retractable screen device.
Figure 3:
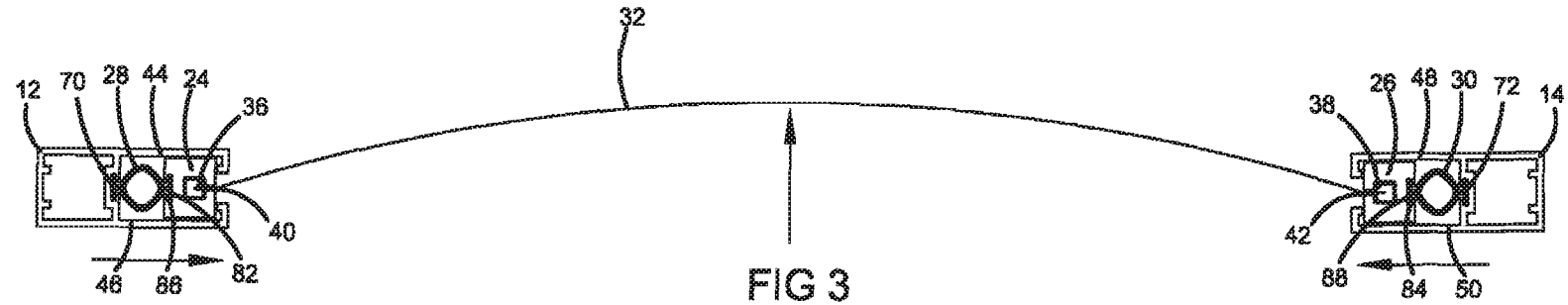
FIG. 3 is a cross sectional view of the retractable screen device with pressure applied to the screen
Figure 2:
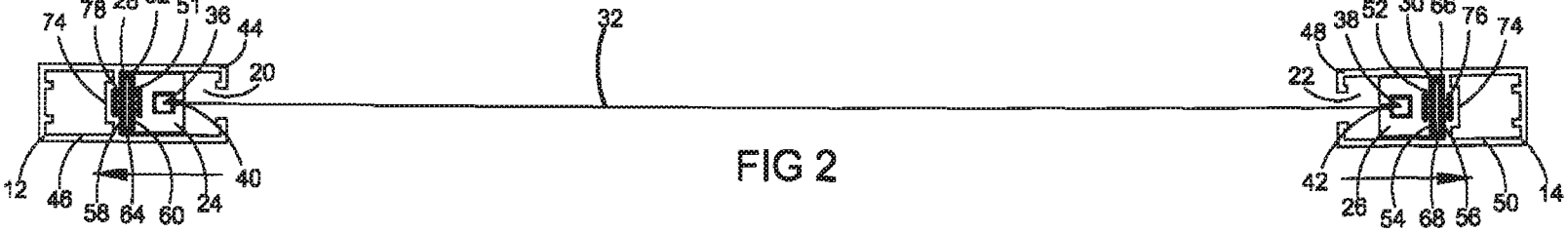
FIG. 2 is a cross sectional view of the retractable screen device without pressure applied to the screen.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Referring generally to the Figures, disclosed is a retractable screen device 10 for a framed opening defined by a header 100 with side supports 102 and 104 bounded by a bottom or floor 106. The retractable screen device 10 is further defined by a first frame track 12 fastened to a side support 102, a second frame track 14 fastened to a side support 104, and a horizontally disposed rotatable shaft 15 fastened to the framed opening header 100. The screen 32, having a length configured to extend between the header 100 and the floor 106, is wound onto and deployed from the horizontally disposed rotatable shaft 15. The screen 32 has laterally opposed side edges 36 and 38 constructed and arranged to be slidably engaged with the first and second frame tracks 12, 14.

The first frame track 12 and second frame track 14 form compartments 20 and 22 for receipt of guide rails 24 and 26, with decompression gaskets 28 and 30 positioned between the frame tracks 12 and 14 and the guide rails 24 and 26. The screen 32 has laterally opposed side edges 36 and 38 with elongated flexible protrusions 40 and 42 secured along the length of each side edge 36 and 38. The guide rails 24 and 26 receive and guide the screen protrusions 40 and 42 along a longitudinal direction. In the preferred embodiment, the guide rails 24 and 26 are constructed from polyvinyl chloride (PVC) or a molded synthetic resin which provides a near frictionless engagement with the elongated flexible protrusions 40 and 42, which are also constructed from plastic, nylon or the like material that is inherently friction reduced with PVC.

The decompression gaskets 28 and 30 allow the guide rails 24 and 26 to traverse the frame track side walls 44, 46, 48 and 50 to permit the screen 32 to flex while maintaining a consistent tension on the screen.

Decompression gaskets 28 and 30 are formed from rubber, silicon, PVC or the like flexible sealing material having first walls 51 and 52 with inner surfaces 54 and 56 and outer surfaces 58 and 60 bounded by first side edges 62 and 64 and second side edges 66 and 68 extending the length of said guide rails 24 and 26. The outer surfaces 58 and 60 having tab members 70 and 72 securable to the first receptacles 74 and 76 of the frame tracks 12 and 14, and second walls 78 and 80 forming a mirror image of the first walls 51 and 52 sharing the first side edges 62 and 64 and the second side edges 66 and 68 with second wall tab members 82 and 84 securable to the second receptacles 86 and 88 of guide rails 24 and 26. The decompression gaskets 28 and 30 provide resistance when the tab members 70 and 72 of the first wall members 51 and 52 are spaced apart from tab members 82 and 84 of the second wall members 78 and 80.

Guide rail front chambers 20 and 22 are constructed and arranged to receive and guide the screen flexible protrusions 40 and 42 along a longitudinal direction. Decompression gaskets 28 and 30 allow the guide rails 24 and 26 to traverse the frame track side walls 44, 46, 48 and 50 to permit the screen 32 to flex while maintaining a consistent tension on the screen by resisting the spacing of tab members 70, 72 and 82, 84.

To keep the screen taunt, rubber or the like material is attached to the center axle that the screen wraps around so as to apply even pressure across the entire width of the screen. If any area of the screen touches the floor, a biasing means would adjust the pressure for that area and to keep the screen tight. The following figures refer to illustrations depicting how the mechanism would function.

Figure 4A:
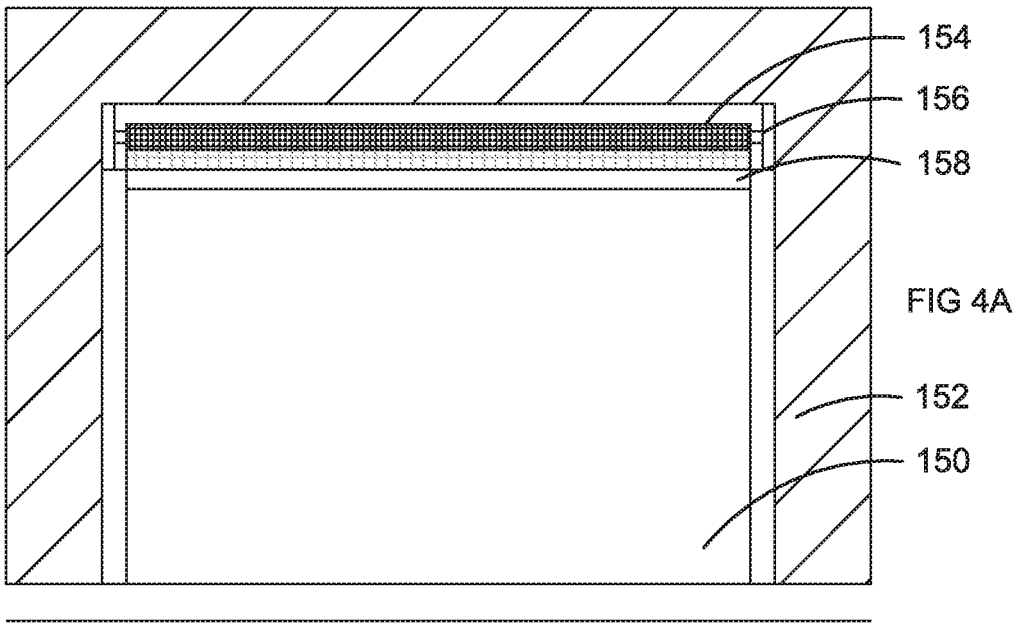
FIG. 4A is a pictorial that illustrates an opening with a screen retracted with the bottom lift bar level to the opening.

FIG. 4A is a pictorial view that illustrates an opening 150 for a building 152 with a screen 154 retracted around an axle 156. A bottom lift bar 158 is shown level to the opening 150.

Figure 4B:
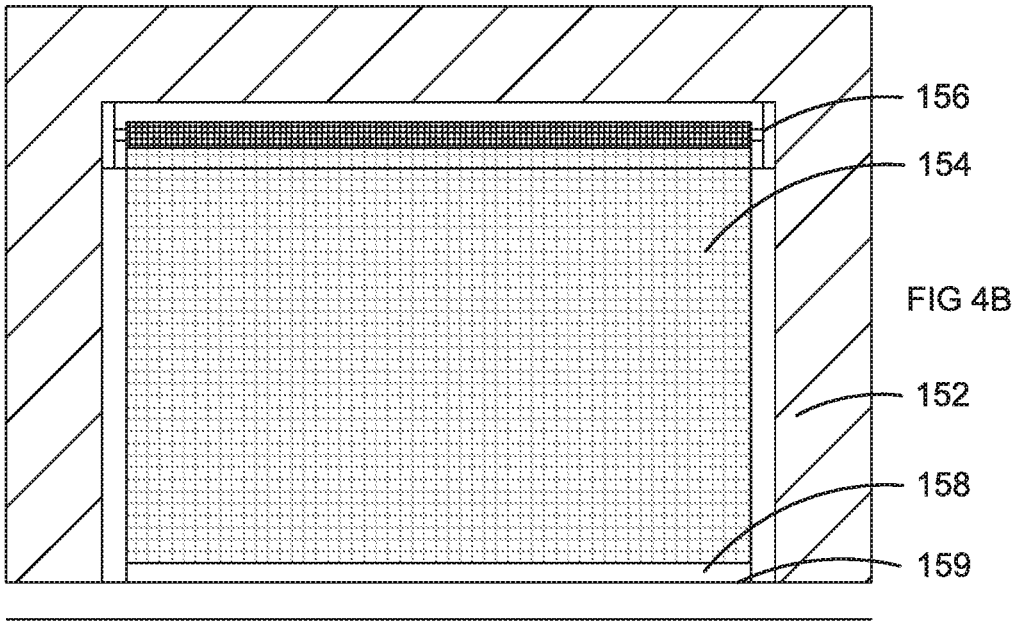
FIG. 4B is a pictorial that illustrates an opening with the screen deployed and the bottom lift bar adjusted to a level floor.

FIG. 4B is a pictorial view that illustrates the opening 150 with the screen 154 deployed and the bottom lift bar 158 adjusted to a level floor 159. The tension on the screen 156 remains constant across the entire width by use of a biasing means that provides a self-leveling.

Figure 5A:
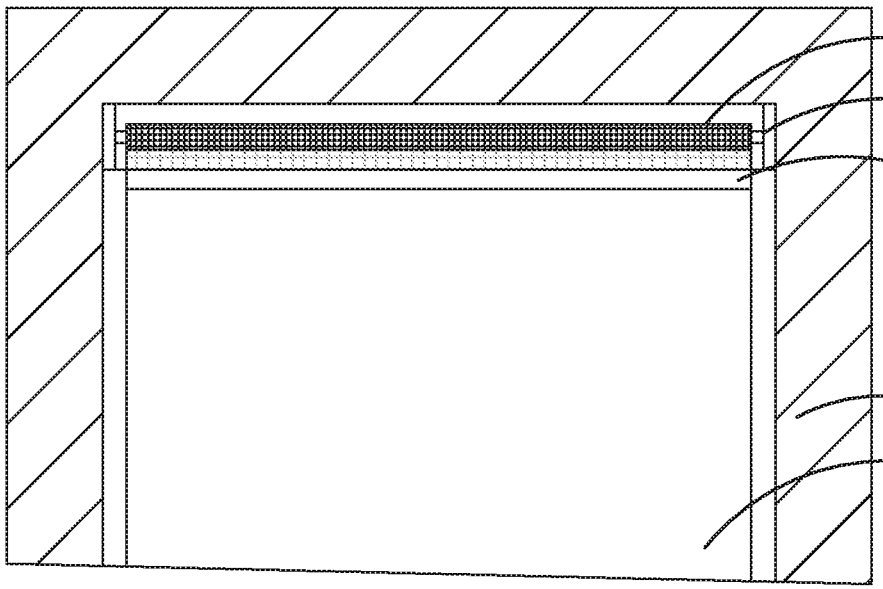
FIG. 5A is a pictorial that illustrates an opening with a screen retracted with the bottom lift bar level to the opening.

FIG. 5A is a pictorial view that illustrates an opening 160 for a building 162 with a screen 164 retracted around an axle 166. A bottom lift bar 168 is shown level to the opening 160.

Figure 5B:
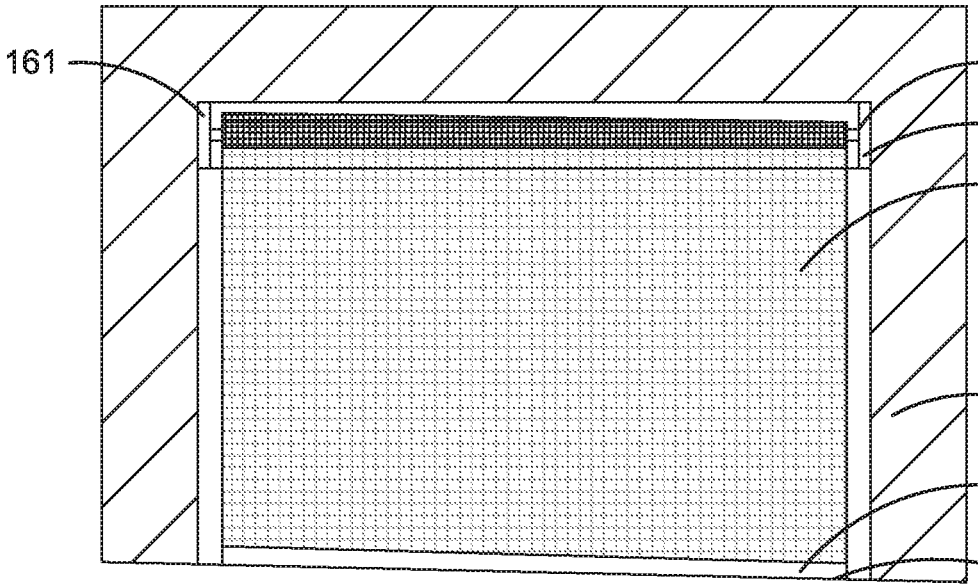
FIG. 5B is a pictorial that illustrates an opening with the screen deployed and the bottom lift bar adjusted to a floor surface that is pitching down from left to right.

FIG. 5B is a pictorial that illustrates the opening 160 with the screen 164 deployed and the bottom lift bar 168 adjusted to a floor surface 169 that is pitching down from left to right. The tension on the biasing means self-leveling device raises the screen on the left 161 and allows the screen on the right 163 to meet with the floor surface 169.

Figure 6A:
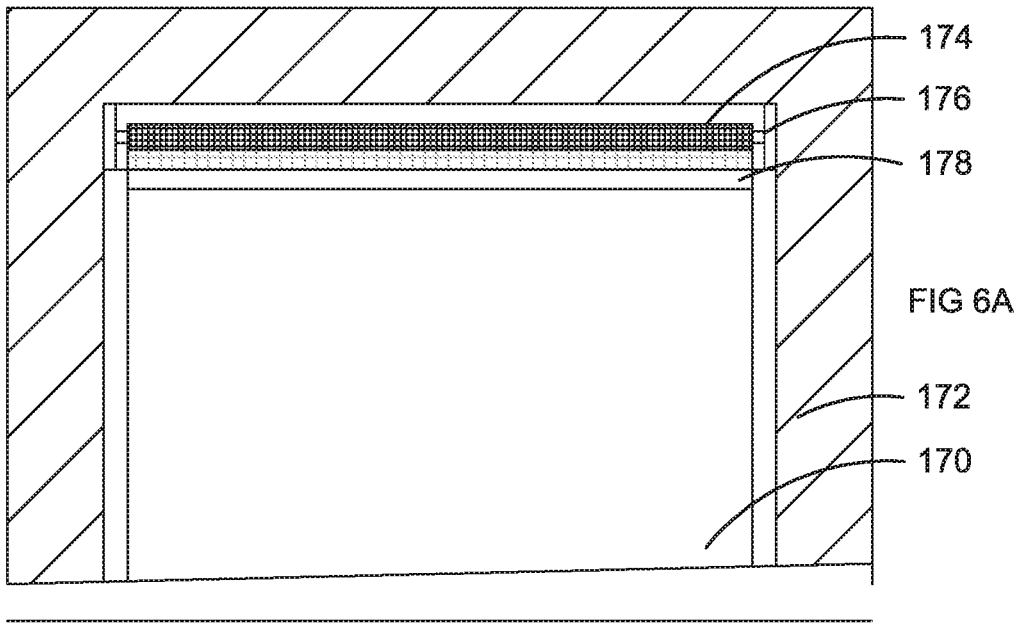
FIG. 6A is a pictorial that illustrates an opening with a screen retracted with the bottom lift bar level to the opening.

FIG. 6A is a pictorial that illustrates an opening 170 for a building 172 with a screen 174 retracted around an axle 176. A bottom lift bar 178 is shown level to the opening 170.

Figure 6B:
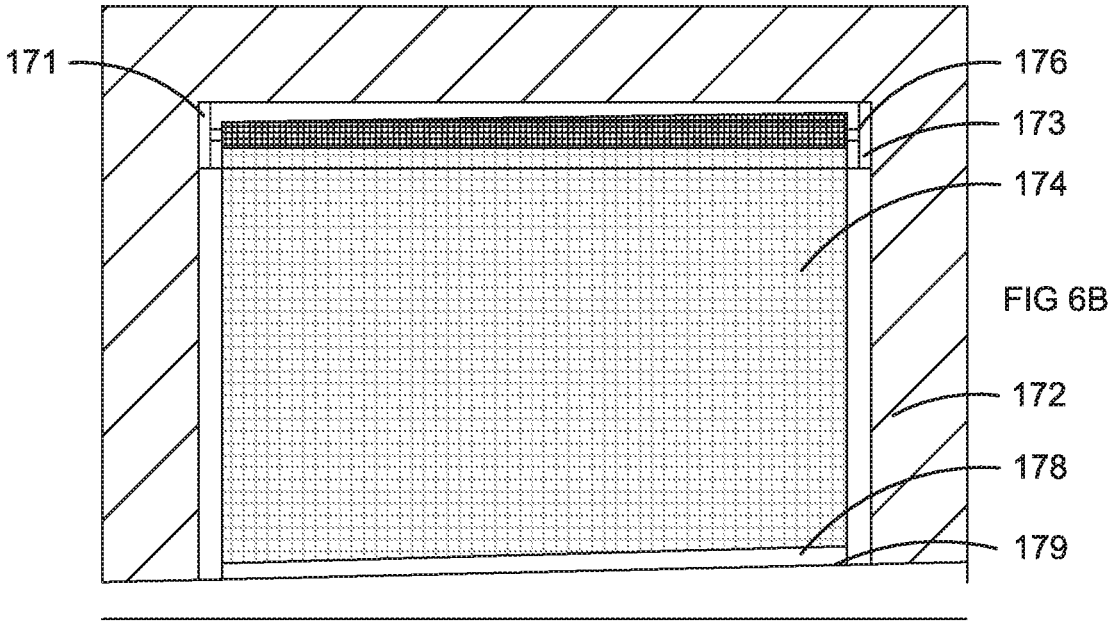
FIG. 6B is a pictorial that illustrates an opening with the screen deployed and the bottom lift bar adjusts to a floor surface that is pitching down from right to left.

FIG. 6B is a pictorial that illustrates an opening 170 with the screen 174 deployed and the bottom lift bar 178 adjusts to a floor surface 179 that is pitching down from right 173 to left 171. The tension on the biasing means self-leveling device raises the screen 174 on the right 173 and allows the screen on the left 171 to meet with the floor surface 179.

Figure 7A:
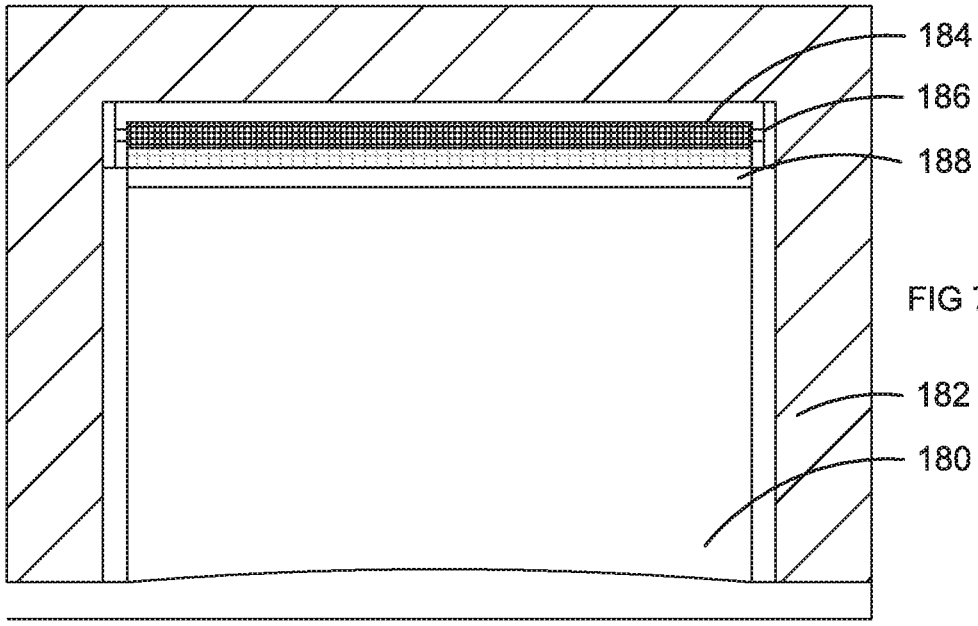
FIG. 7A is a pictorial that illustrates an opening with a screen retracted with the bottom lift bar level to the opening.

FIG. 7A is a pictorial that illustrates an opening 180 for a building 182 with a screen 184 retracted around an axle 186. A bottom lift bar 188 is shown level to the opening 180.

Figure 7B:
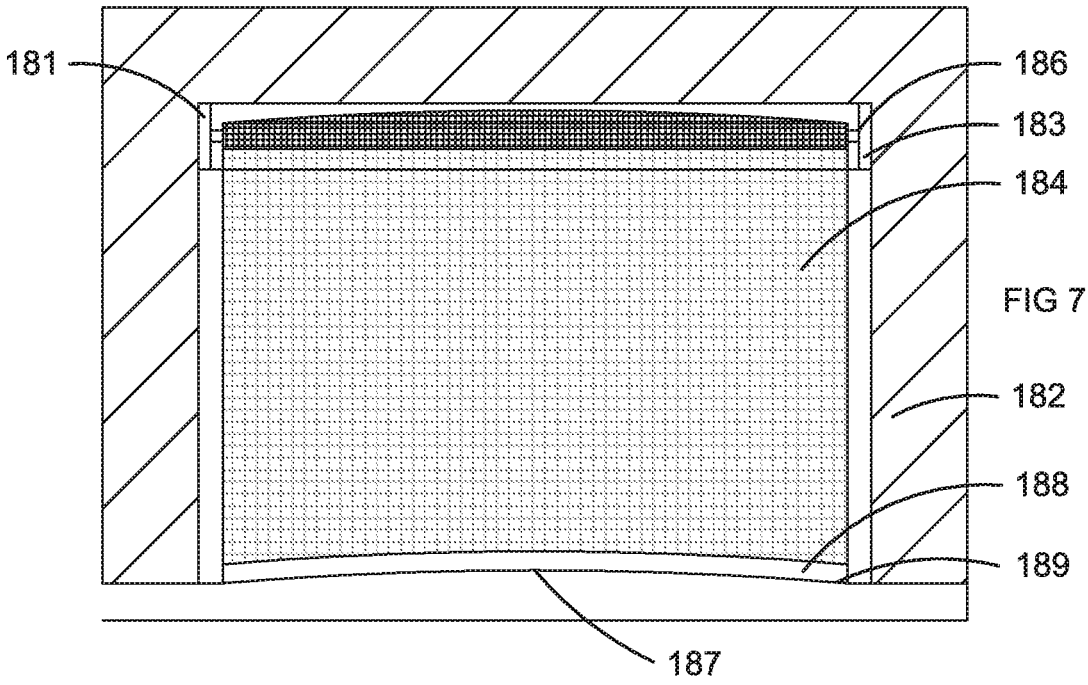
FIG. 7B is a pictorial that illustrates an opening with the screen deployed and the bottom lift bar adjusts to a floor surface that is crowning up at the center.

FIG. 7B is a pictorial that illustrates an opening 180 with the screen 184 deployed and the bottom lift bar 188 and the bottom lift bar 188 adjusts to a floor surface 189 that has a crown 187 defined between the left side 181 and the right side 183. The tension on the biasing means self-leveling device raises the screen 184 in the center and allows the screen on the left 181 and right 183 to meet the floor 189.

Figure 8A:
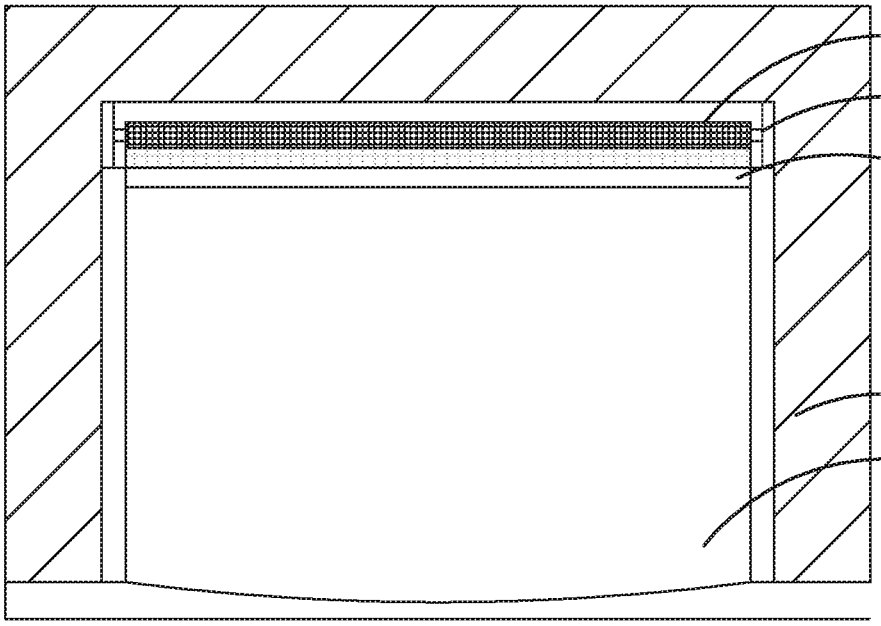
FIG. 8A is a pictorial that illustrates an opening with a screen retracted with the bottom lift bar level to the opening.

FIG. 8A is a pictorial that illustrates an opening 190 for a building 192 with a screen 194 retracted around an axle 196. A bottom lift bar 198 is shown level to the opening 190.

Figure 8B:
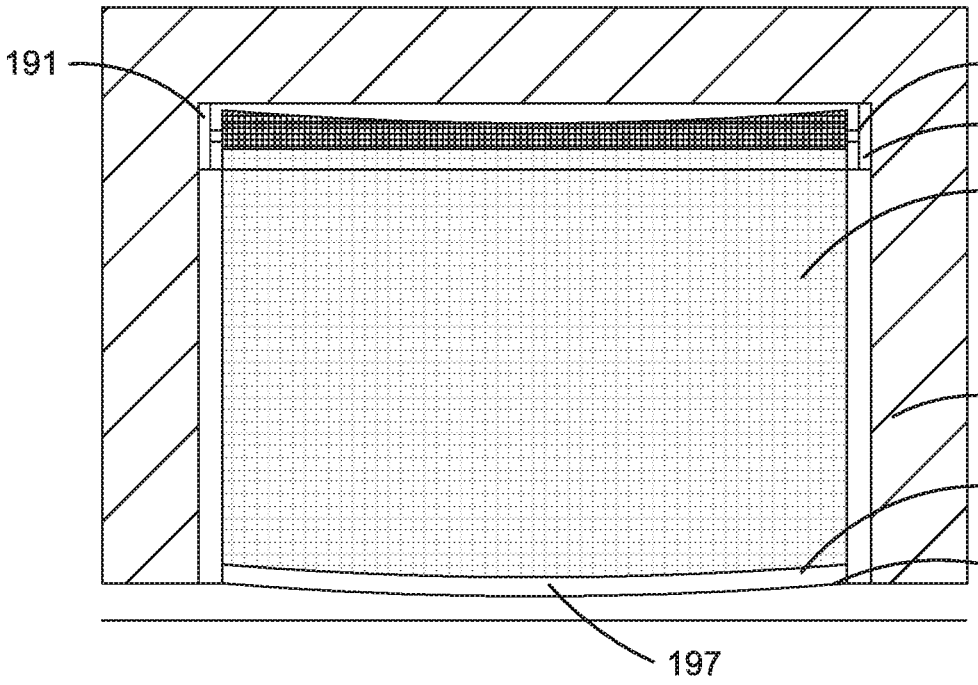
FIG. 8B is a pictorial that illustrates an opening with the screen deployed and the bottom lift bar adjusts to a floor surface that is dipping down at the center.

FIG. 8B is a pictorial that illustrates an opening 190 with the screen 194 deployed and the bottom lift bar 198 adjusts to a floor surface that has a dip 197 at the center. The tension on the biasing means self-leveling device raises the screen on the left 191 and right 193 allowing the screen in the center to meet with the floor surface 199.

Figure 9:
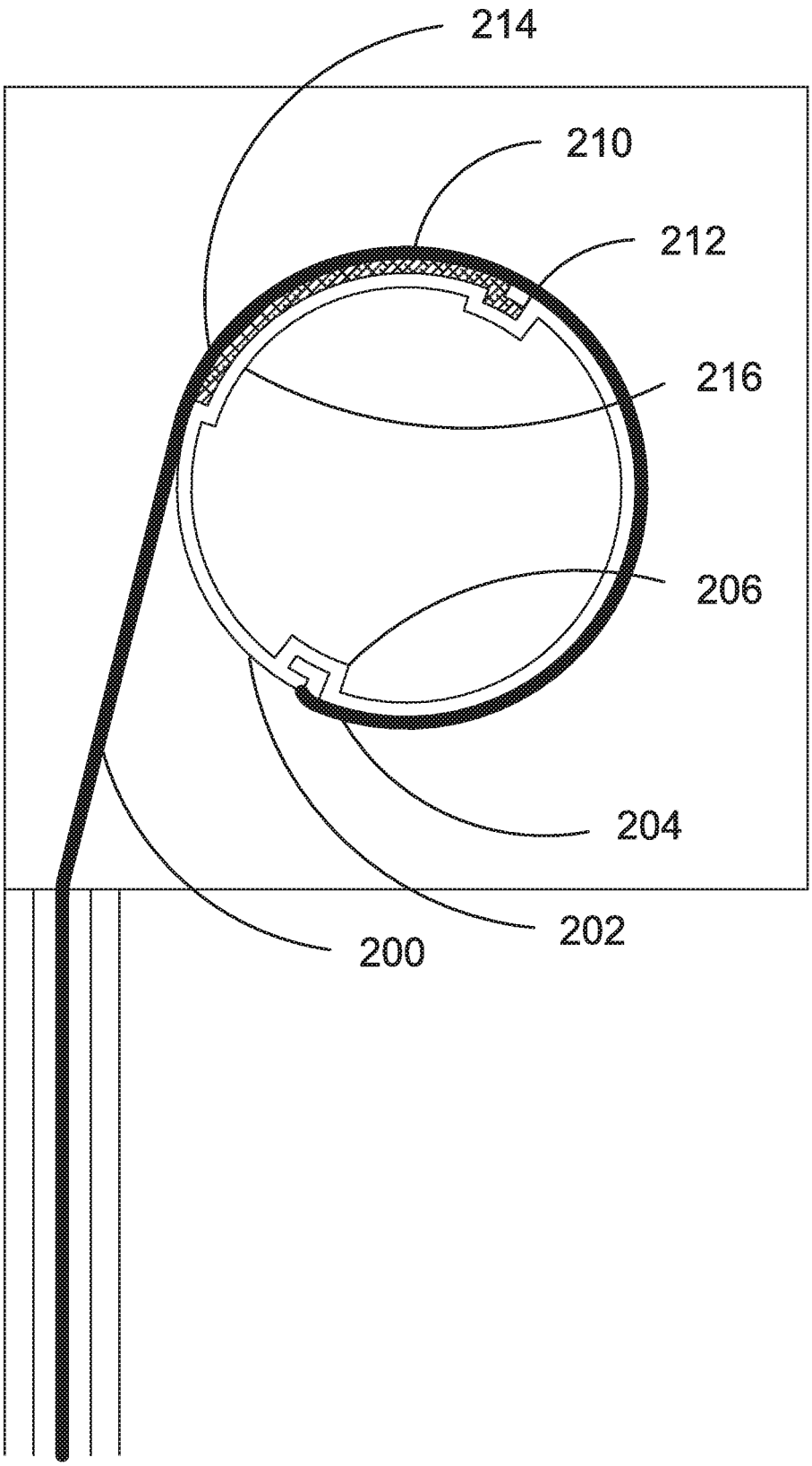
FIG. 9 is a cross sectional view illustrating a screen wrapped around a center axle.

FIG. 9 is a cross sectional view illustrating a screen 200 wrapped around a center axle 202. An end 204 of the screen 204 is coupled to the center axle by use of a receptacle 206 or the like attachment. The weight of the lift bar, as illustrated in the previous illustrations causing the biasing means self-leveling device 210 to compress and also wrap around the center axle. The biasing means 210 having a first side edge 212 coupled to the center axle and a second side edge 214 spaced apart from the first sided edge 212 a predetermined distance based upon the type of material used in the biasing member. In this embodiment the biasing means 210 second side edge 214 fits within an axle 202 having an indentation 216 that allows the screen 200 to smoothly wrap around the axle 202. The biasing means self-leveling device 210 is preferably constructed from a piece of flexible rubber. Alternatively, the biasing means can be PVC flexible plastic, silicon, spring steel, a combination thereof, or any other material capable of providing an even spring like tension to the screen.

Figure 10:
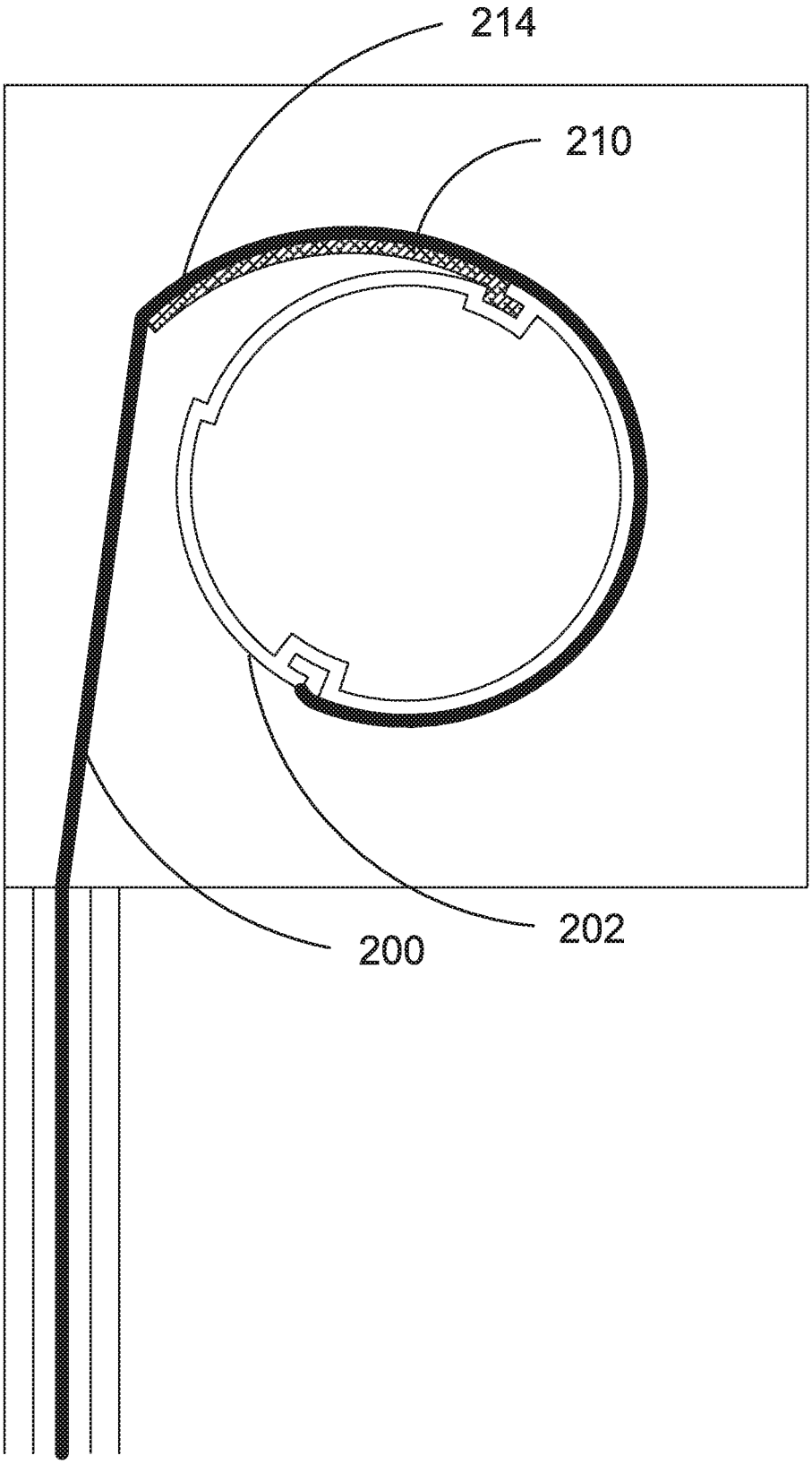
FIG. 10 is a cross sectional view illustrating a screen wrapped around the center axle with the self-leveling device partially decompressed.

FIG. 10 is a cross sectional view illustrating the screen wrapped around the center axle 202 with the biasing means self-leveling device partially decompressed. In this illustration the screen 200 is wrapped around center axle 202 and when the lift bar, not shown, meets the floor surface the biasing means 210 partially decompresses and raise the screen 200 to maintain even tension across the entire width of the unit.

Figure 11:
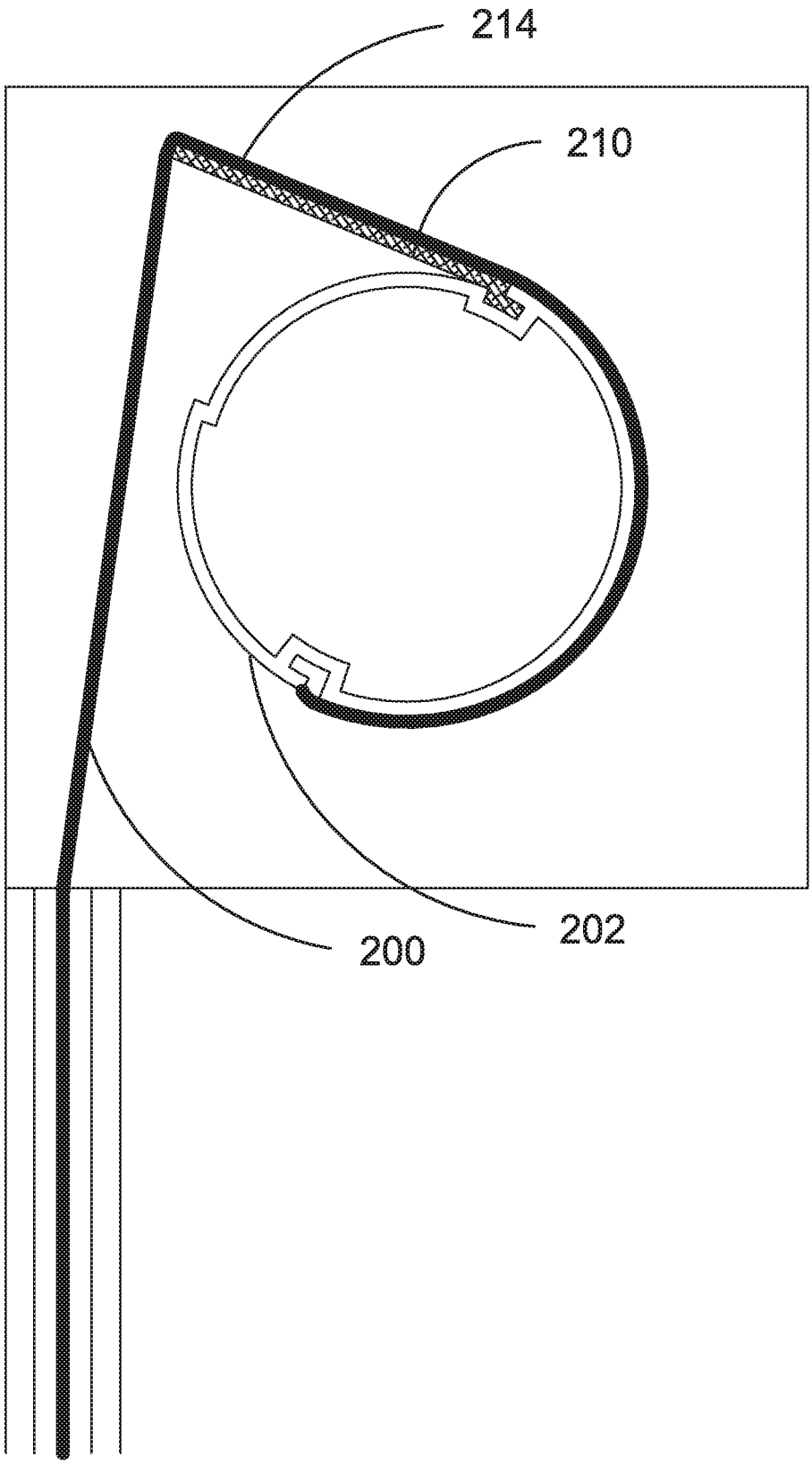
FIG. 11 is a cross sectional view illustrating a screen wrapped around the center axle with the "self-leveling device" fully decompressed.

FIG. 11 is a cross sectional view illustrating the screen 200 wrapped around the center axle 202 with the biasing means 210 fully decompressed, the second end 214 extending outward to provide maximum but even tension across the entire width of the unit.

The term "coupled" is defined as connected, although not necessarily directly, and not necessarily mechanically. The use of the word "a" or "an" when used in conjunction with the term "comprising" in the claims and/or the specification may mean "one," but it is also consistent with the meaning of "one or more or at least one." The term "about" means, in general, the stated value plus or minus 5%. The use of the term or in the claims is used to mean "and/or" unless explicitly indicated to refer to alternatives only or the alternative are mutually exclusive, although the disclosure supports a definition that refers to only alternatives and "and/or."

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements, possesses those one or more steps or elements, but is not limited to possessing only those one or more elements. Likewise, a step of a method or an element of a device that "comprises," "has," "includes" or "contains" one or more features, possesses those one or more features, but is not limited to possessing only those one or more features. Furthermore, a device or structure that is configured in a certain way is configured in at least that way, but may also be configured in ways that are not listed.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirt of the invention and are defined by the scope of the appended claims. Although the invention has been described in connection with specific preferred embodiments, it should be understood that the invention as claimed should be unduly limited such specific embodiments. Indeed, various modifications of the described modes for carrying out the invention which are obvious to those skilled in the art are intended to be within the scope of the following claims.

What is claimed is:

1. A retractable screen device for a framed opening, said framed opening defined by a header, opposing side supports, and a bottom, said retractable screen device comprising:

a frame track fastened to each side support, said frame track forming a compartment defined by a rear wall having a front receptacle, opposing side walls having a depth, and a front wall having a centrally disposed access channel extending the longitudinal length of said frame track;

a guide rail positioned within said compartment of each frame track extending said longitudinal length of each said frame track, said guide rail having a front chamber axially aligned with said centrally disposed channel and a rear receptacle extending the longitudinal length of said guide rail with opposing side walls having a depth;

a decompression gasket formed from a first wall having an inner surface and outer surface bounded by a first side edge and a second side edge extending the length of said guide rail, said outer surface having a tab member securable to said first receptacle of said frame track, and a second wall forming a mirror image of said first wall sharing said first side edge and said second side edge with said second wall tab member securable to said second receptacle of said guide rail, said decompression gasket providing resistance with said tab of said first wall member spaced apart from said tab member of said second wall member;

a screen having a length configured to be wound onto and deployed from a horizontally disposed rotatable shaft secured to said header, said screen having laterally opposed side edges with an elongated flexible protrusion secured along the length of each said side edge;

wherein said guide rail front chamber is constructed and arranged to receive and guide said screen flexible protrusion along a longitudinal direction and said decompression gasket allows said guide rail to traverse said frame track side walls to permit said screen to flex while maintaining a consistent tension on said screen by resisting the spacing of said tab members.

2. The retractable screen device according to claim 1 wherein said support is constructed of aluminum having a compartment first depth that is greater than said guide rail depth.

3. The retractable screen device according to claim 1 wherein said decompression gasket is formed of rubber, silicon, PVC flexible material.

4. The retractable screen device according to claim 1 wherein said decompression gasket first inner wall is juxtaposed to said second inner wall in a normally unbiased position and provides a biasing member upon spacing apart of said first and second inner wall.

5. The retractable screen device according to claim 1 wherein said protrusion is constructed from PVC.

6. The retractable screen device according to claim 1 wherein each said frame track forms a mirror image of an opposing frame track.

7. The retractable screen device according to claim 1 wherein each said guide rail forms a mirror image of an opposing guide rail.

8. The retractable screen device according to claim 1 wherein said guide rail is constructed from a molded synthetic resin.

9. The retractable screen device according to claim 1 wherein the pulling of the decompression gasket increases the distance between the first and second walls, providing a tension to said screen to eliminate screen wrinkles.

* * * * *